US006978524B2

(12) United States Patent
Pluister et al.

(10) Patent No.: US 6,978,524 B2
(45) Date of Patent: Dec. 27, 2005

(54) APPARATUS AND METHOD FOR REMOVING REMNANT MATERIAL FROM A BOBBIN

(75) Inventors: Andrew M. Pluister, Racine, WI (US); Simon Guysinsky, Niles, IL (US); Ricardo Venegas, Kenosha, WI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/827,581

(22) Filed: Apr. 16, 2004

(65) Prior Publication Data

US 2004/0205945 A1 Oct. 21, 2004

Related U.S. Application Data

(60) Provisional application No. 60/463,796, filed on Apr. 18, 2003.

(51) Int. Cl.[7] ..... B65H 73/00
(52) U.S. Cl. ..... 28/295
(58) Field of Search ..... 28/295, 292, 294, 28/296, 297, 298; 83/924, 54, 56, 61–63, 83/613, 614; 15/104.04; 57/300, 305; 30/90.4, 30/90.8, 90.9, 91.1, 392, 280, 314; 134/48, 134/52, 144, 153

(56) References Cited

U.S. PATENT DOCUMENTS

| | | | | |
|---|---|---|---|---|
| 1,119,993 | A | | 12/1914 | Sharples et al. |
| 1,274,522 | A | | 8/1918 | Bronsfield |
| 1,739,775 | A | | 12/1929 | Baker |
| 2,710,440 | A | | 6/1955 | Bauer |
| 3,137,913 | A | | 6/1964 | Hayes |
| 3,431,610 | A | * | 3/1969 | Rose ..... 28/295 |
| 3,640,163 | A | * | 2/1972 | Giardini et al. ..... 83/53 |
| 3,928,899 | A | | 12/1975 | Maiworm |
| 4,078,282 | A | | 3/1978 | van Daalen |
| 4,327,617 | A | * | 5/1982 | Budzich et al. ..... 83/419 |
| 4,461,060 | A | * | 7/1984 | Mannhart ..... 28/295 |
| 4,616,553 | A | | 10/1986 | Nixon |
| 4,845,815 | A | * | 7/1989 | Nelson et al. ..... 28/295 |
| 4,899,532 | A | * | 2/1990 | Sanno ..... 57/304 |
| 4,965,917 | A | | 10/1990 | Ferguson |
| 4,998,331 | A | | 3/1991 | Westman |
| 5,103,525 | A | | 4/1992 | Nakayama |
| 5,303,630 | A | | 4/1994 | Lawrence |
| 5,370,031 | A | | 12/1994 | Koyfman et al. |
| 5,974,938 | A | | 11/1999 | Lloyd |
| 6,325,822 | B1 | | 12/2001 | Chouinard et al. |
| 6,470,543 | B1 | * | 10/2002 | Kamann ..... 28/295 |

* cited by examiner

*Primary Examiner*—Amy B. Vanatta
(74) *Attorney, Agent, or Firm*—Scully, Scott, Murphy & Presser

(57) ABSTRACT

A bobbin stripper for cutting and stripping remnant material such as cable and wire from a bobbin drum. The bobbin stripper comprises a cutting head that includes a cutting blade having a straight side and a tapered side having a sharp edge. The cutting blade is movable in a vertical position and in a horizontal direction substantially parallel to the bobbin drum. Once the cutting blade passes along the length of the bobbin drum in one direction, the cutting blade may be rotated such that the sharp edge may engage and penetrate the remnant material in the reverse direction. The process may be repeated until the desired depth of the incision has been reached. A stop and sensor prevent the blade from cutting the drum. The remnant material may thereafter be removed by a pair of stripping plates.

35 Claims, 4 Drawing Sheets

APPARATUS AND METHOD FOR REMOVING REMNANT MATERIAL FROM A BOBBIN

This application claims priority to U.S. Provisional Patent Application Ser. No. 60/463,796, filed on Apr. 18, 2003.

FIELD OF THE INVENTION

The present invention relates generally to an apparatus and method for removing residual or remnant material from a bobbin, and more particularly to a bobbin stripper for cutting an incision into unused or remnant electrical wire and/or cable, and for stripping the remnant material therefrom.

BACKGROUND OF THE INVENTION

Supply bobbins or spools for storing a variety of different products for use in a variety of different industries. For example, it has been known to use bobbins for storing a length of electrical wire or cable, wherein the wire and cable may be braided in a known way through the use of a braiding machine. In particular, the cable or wire is initially wound about the bobbin so that it may be unwound for later use. However, oftentimes the entire length of cable or wire is not used, wherein the remainder of the cable or wire (or the remnants) remains wound on the bobbin.

Generally, the bobbins are constructed so that they may be re-used. However, before additional cable or wire can be wound on the used bobbin, any unused or remnant cable or wire must be removed. In the past, the remnant cable or wire was typically removed manually using a knife. However, there are several disadvantages of this process. First, manually using a knife is time-consuming because only one bobbin can be cleared of remnant material at a time. Second, this process poses a significant safety risk to the person using the knife. Third, the knife used may cut or scratch the surface of the bobbin, thereby affecting its ability to be re-used, or, if it is re-used, potentially causing damage to the cable or wire that is subsequently wound on the bobbin. Further still, in cases where the wire or cable is extremely thick or made from a harder material, manual removal of remnant cable or wire with a knife may be unfeasible.

Therefore, there is a need for an apparatus and method for removing remnants from a bobbin that solves these problems, while being economical and easy to manufacture and install.

SUMMARY OF THE INVENTION

The present invention is an improvement over the prior apparatus and ways for removing remnant material from a bobbin in, among other things, the way that the cutting element is operated to cut the remnant material from the bobbin is unique. In particular, the apparatus includes a support shaft for accepting a bobbin having remnant material wound about the drum of the bobbin. A pair of locking plates having serrated ends may pivotally engage the bobbin to retain the bobbin in place during operation of the apparatus. The remnant removing or stripping apparatus further comprises a cutting head having a cutting element such as a cutting blade that is movably and rotatably supported to permit the blade to make a series of longitudinal cutting passes over the remnant material in a first and second direction. In particular, the movement of the cutting head and blade is controlled by a pair of thrusters that operate to move the cutting head vertically or horizontally. Upon completing a longitudinal cutting pass, the cutting blade may rotate 180 degrees to permit the cutting blade to cut the remnant material in the opposite direction. The blade may continue to make cutting passes along the drum of the bobbin until a sensor on the frame body detects a stop on the cutting head, thereby controlling the depth of the incision and protecting the drum of the bobbin from being damaged.

Once the sensor detects that the desired depth for the incision is achieved, a pair of stripping plates having a downwardly angled gripping portion are maneuvered such that the gripping portion engages the incision to facilitate removal of the remnant material. The stripping plates are biased toward the locking plate through the use of an extension spring to strip the remnant material from the bobbin. In order to ensure that the blade properly cuts the remnant material from the bobbin, the system and method may incorporate one or more templates that are sized to accommodate a bobbin of a particular size. Accordingly, if a different sized bobbin is introduced to the apparatus, the template will prevent the bobbin from being placed on to the support shaft.

It is therefore an object of the present invention to provide an apparatus for removing unused or remnant material from a bobbin.

Another object of the present invention is to provide an apparatus for cutting an incision into unused or remnant material wound about a bobbin, and for stripping the remnant material there from.

A third object of the present invention is to provide a bobbin stripper for cutting an incision into unused or remnant electrical wire and/or cable without damaging the bobbin.

Yet another object of the present invention is to provide a blade that may be mechanically operated to cut remnant material from a bobbin in two directions.

Still another object of the present invention is to provide an apparatus and method for cutting remnant material from bobbins of different sizes.

Other objects, features and advantages of the invention will be apparent from the following detailed disclosure, taken in conjunction with the accompanying sheets of drawings, wherein like reference numerals refer to like parts.

WRITTEN DESCRIPTION OF THE INVENTION

Figure 1:
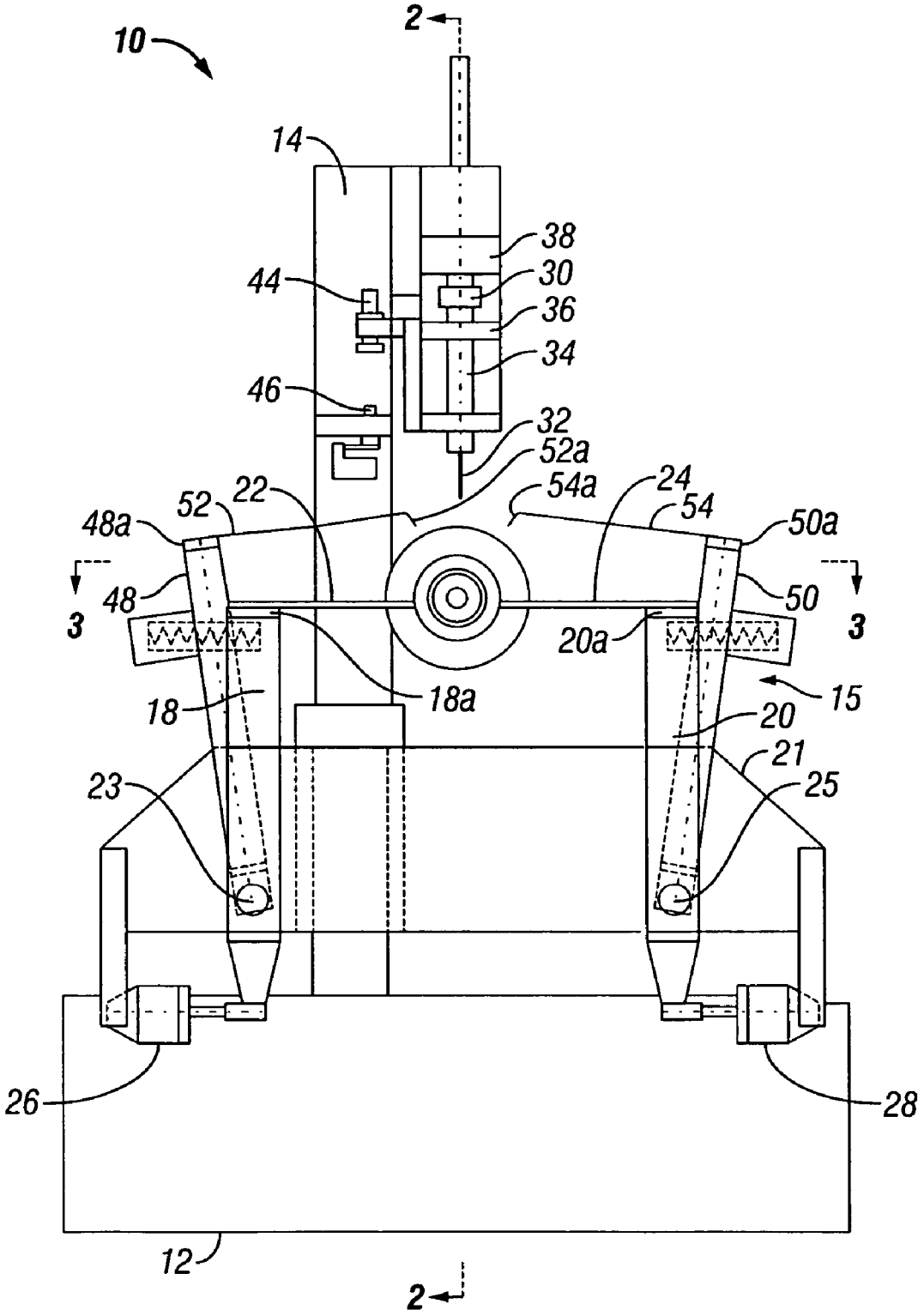
FIG. 1 is a front-view of an embodiment of a bobbin stripper of the present invention.

While this invention is susceptible of embodiment in many different forms, there is shown in the drawings and will herein be described in detail one specific embodiment, with the understanding that the present disclosure is to be considered merely an exemplification of the principles of the invention and is not intended to limit the invention to the embodiment illustrated.

Figure 2:
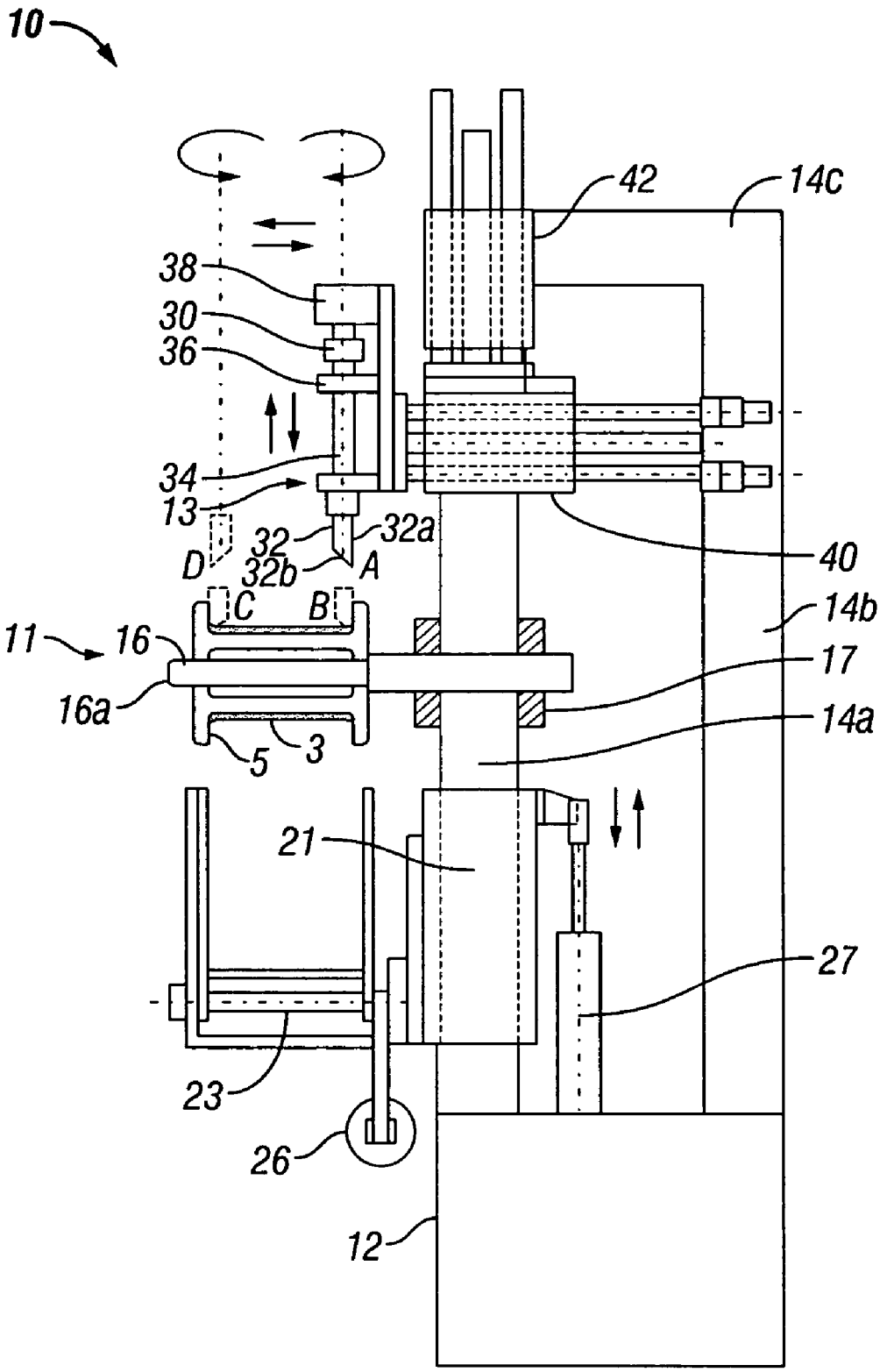
FIG. 2 is a cross-sectional view of the bobbin stripper taken along line 1—1 of FIG. 1.
Figure 3:
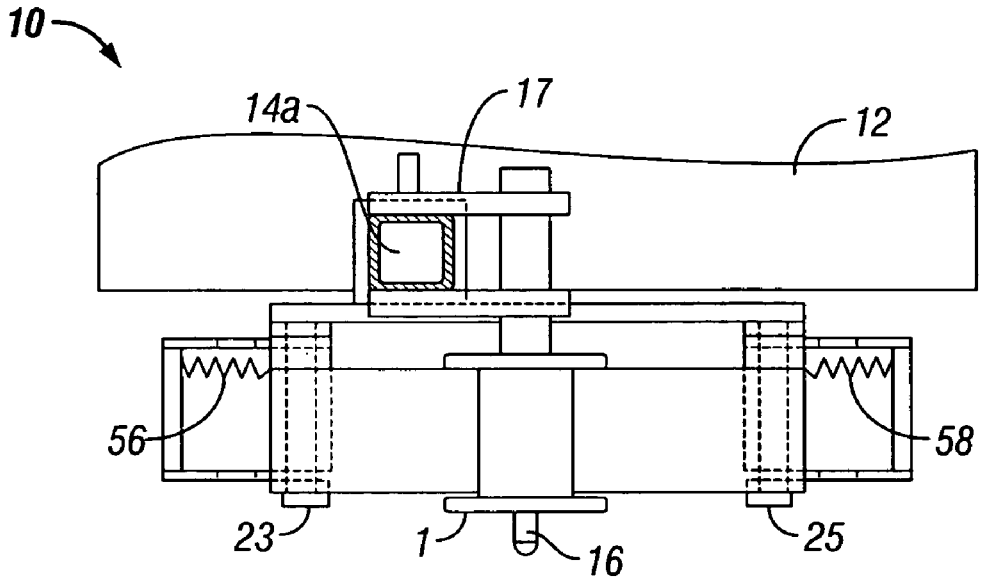
FIG. 3 is a cross-sectional view of the bobbin stripper taken along line 2—2 of FIG. 2.

Referring now to the drawings, and particularly FIGS. 1 through 3, there is shown a preferred embodiment of the present invention. The bobbin stripper apparatus, generally designated by the numeral 10, is shown having a base 12, an apparatus frame 14, a bobbin retainer assembly 11, a cutting assembly 13, and a remnant material stripper assembly 15.

Referring again to FIGS. 1 and 2, the base is preferably rectangular in shape but may be of a variety of shapes and sizes and not depart from the scope of the present invention, provided it is of a sufficient size to stably support the apparatus on a resting surface such as a floor. The apparatus frame, as shown in FIGS. 1 through 3 is preferably a substantially U-shaped frame bracket 14 that is fixedly mounted to the base 12, however, it is appreciated that the bracket may be removably mounted and not depart from the scope of the present invention. The frame bracket 14 preferably includes first and second vertically extending frame bracket members 14*a*, 14*b*, and a horizontally extending frame bracket member 14*c* which, in combination, support the various components of the bobbin stripper 10. While a substantially U-shaped frame bracket is shown and disclosed, it is appreciated that the apparatus frame may comprise a variety of different shapes and/or sizes and not depart from the scope of the present invention.

Figure 4:
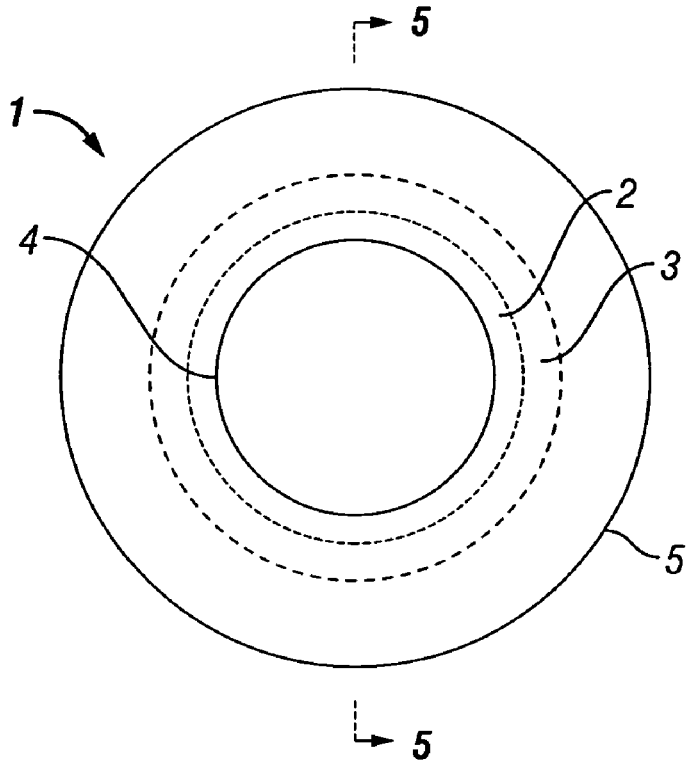
FIG. 4 (Prior Art)
FIG. 4 is an end-view of a conventional bobbin.
Figure 5:
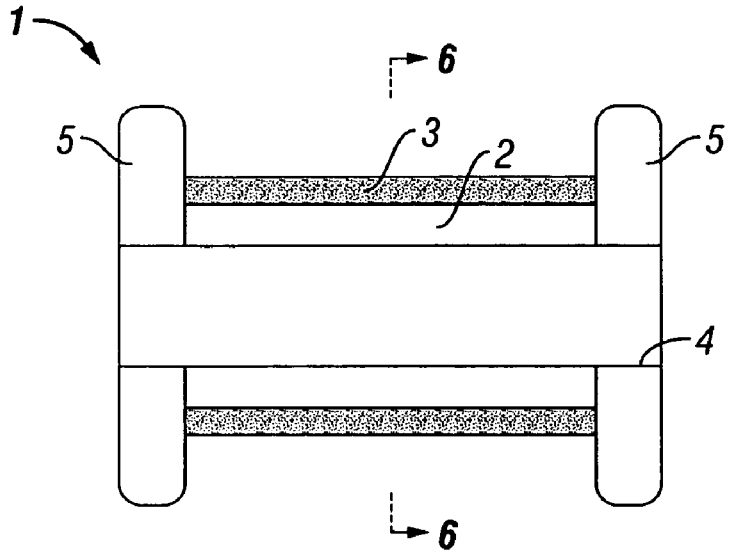
FIG. 5 (Prior Art)
FIG. 5 is a cross-sectional view of the bobbin taken alone line 5—5 of FIG. 4.

The bobbin retaining assembly 11 is designed to retain a bobbin 1 during operation of the bobbin stripper apparatus 10. Referring to FIGS. 4 and 5, a conventional bobbin 1 that may be used in the present invention is shown. The bobbin 1 includes a drum or sleeve 2, an axially extending bore 4, and two end flanges 5. In use, a continuous length of remnant material 3 (e.g., fibrous material, wire, cable and the like) is generally wound about the drum 2 and between the flanges 5 in a known way. It is appreciated that the bobbin shown in FIGS. 4 and 5 is only one example of the types of bobbins that may be used with the present invention.

In a preferred embodiment, the bobbin retaining assembly 11 includes a horizontally extending bobbin support shaft 16 adapted to be received by the bobbin bore 4. The bobbin support shaft 16 may optionally be provided with a tapered end 16*a* that assists in the initial insertion of the support shaft 16 into the bobbin bore 4. While it is preferred that the bobbin may be secured in a horizontal position, it is appreciated that the bobbin may be stored vertically or at an angle and not depart from the scope of the present invention.

In order to accommodate bobbins of various sizes and to ensure that the apparatus is properly set to cut the remnant material from a bobbin of a particular size, it is appreciated that the apparatus may include one or more templates that are sized to accept or accommodate a bobbin of a particular size and shape. Accordingly, in operation, if a different sized bobbin is attempted to be inserted into the template, the template will prohibit the bobbin from being placed over the support shaft. The apparatus may thereafter be adjusted or set to cut remnant material from the selected bobbin, or another bobbin may be inserted into the apparatus.

Preferably, the bobbin support shaft 16 is operably associated with the frame bracket 14. Most preferably, the support shaft 16 is fixedly connected to a clamp member 17 that is removably coupled to the first frame bracket member 14*a*. In operation, the bobbin support shaft 16 is inserted into the bobbin bore 4, and supports the bobbin 1 during the removal of the remnant material 3 from the bobbin 1.

In order to inhibit movement of the bobbin 1 on the support shaft 16 during operation of the apparatus 10, it is appreciated that the bobbin may be removably locked or secured relative to the support shaft during the removal of the remnant material 3 from the bobbin 1. As shown in FIGS. 1 through 3, a preferred embodiment includes locking plate arms 18, 20 that are individually pivotally attached to a slide member 21 by axles 23, 25, respectively, that are positioned on opposing sides of the bobbin support shaft 16.

The slide member 21 is preferably slidably associated with the first frame bracket member 14*a*. In the preferred embodiment, a slide member actuator 27 operably associated with the slide member 21 and the base 12 actuates the slide member in the vertical direction along the first frame bracket member 14*a*, causing the slide member 21 to slide or translate from a raised position to a lowered position, and vise-versa. Preferably, the slide member actuator 27 is a selectively actuated hydraulic or pneumatic piston, but it is appreciated it may be any known type of actuator that acts to move the slide member 21 between a raised and a lowered position. It is also appreciated that the slide member may be manually operated to raise or lower the slide member.

A pair of substantially horizontally extending locking plates 22, 24 are fixedly and individually attached to the upper end 18*a*, 20*a* of each locking plate arm 18, 20. In particular, locking plate 22 is attached to the upper end 18*a* of locking plate arm 18 and locking plate 24 is attached to the upper end 20*a* of locking plate arm 20. Preferably, the ends of the locking plates 22, 24 that contact the remnant material on the bobbin drum are serrated to assist the locking plates in gripping the remnant material on the bobbin. While it is preferred that the locking plates be substantially horizontal, it is appreciated that they may be substantially vertical or at an angle and not depart from the scope of the present invention. In operation, when a bobbin 1 is positioned or supported on the support shaft 16, the locking plates 22, 24 pivot towards the bobbin 1 and engage the remnant material 3 so as to substantially prevent any movement of the bobbin 1 on the support shaft 16 during the cutting process.

Locking arm actuators 26, 28 operably associated with each locking plate arm 18, 20 and with the slide member 21 allow for the locking plate arms 18, 20 to pivot toward the bobbin 1 to an engaged position, and away from the bobbin 1 to a disengaged position. Particularly, locking arm actuator 26 is operably associated with locking plate arm 18, while locking arm actuator 28 is operably associated with locking plate arm 20. While the locking arm actuators 26,28 are preferably selectively actuated hydraulic or pneumatic pistons, it is appreciated that they may be any of the known actuators and not depart from the scope of the present invention. It is further appreciated that the locking arms may be manually operated to engage the bobbin to substantially lock the bobbin in place during operation of the apparatus.

Referring again to FIGS. 1 through 3, the cutting assembly 13 comprises a cutting head 30 having a cutting element 32. In a preferred embodiment, the cutting head comprises a cutting head shaft 34 and a shaft mount 36 for supporting the cutting head shaft 34. Preferably, the cutting head shaft 34 is rotatably positioned in the shaft mount 36. A selectively actuated hydraulic or pneumatic turn activator 38 that is operably associated with the shaft mount 36 and is in rotation transfer relationship with the cutting head shaft 34, or known device for rotating the cutting head shaft, acts to selectively rotate the cutting head shaft 34 during operation. One example of an alternative actuator comprises a selectively actuable electric solenoid.

In the preferred embodiment, the cutting element comprises a cutting blade 32 that is attached to a cutting head shaft 34 in a known way. The cutting blade preferably includes a straight side 32*a* and a tapered side 32*b* having a sharp edge for cutting the remnant material.

In operation, the cutting head 30 moves forward and backward longitudinally (or horizontally) along a path that extends substantially parallel to the drum 2 of the bobbin, and up and down in the vertical direction. Referring again to FIGS. 1 through 3, it is preferred that the movement of the cutting head be controlled through a horizontal thruster 40 and a vertical thruster 42. Preferably, the horizontal thruster is a selectively actuated hydraulic or pneumatic horizontal thruster 40 operably associated with a selectively actuated hydraulic or pneumatic vertical thruster 42. While a pair of thrusters is preferred, it is appreciated that the cutting head may be moved through any of the other known ways and not depart from the scope of the present invention.

In the preferred embodiment, the horizontal thruster 40 may be fixedly or removably attached to the shaft mount 36, while the vertical thruster 42 may be fixedly or removably mounted to the first frame bracket member 14*a*. Accordingly, when the vertical thruster 42 is actuated, the cutting head 30 and horizontal thruster 40 both move in the vertical direction; however, when the horizontal thruster 40 is actuated, only the cutting head 30 moves in the horizontal direction. It is also appreciated that the horizontal thruster 40 may be fixedly or removably mounted to the first frame bracket member 14*a*, and the shaft mount 36 may be fixedly or removably mounted to the vertical thruster 42 and not depart from the scope of the present invention.

In order to control the maximum depth of the cuts (and therefore the maximum depth of the incision 3*a*, 3*b*) made into the remnant material 3 by the cutting head 30, the apparatus 10 preferably includes an adjustable stop 44 operably associated with the cutting head 30, and a corresponding sensor 46 (e.g., a microswitch or the like) operably associated with the frame bracket 14. Use of a stop and sensor in connection with the cutting blade prevents the blade from cutting or otherwise damaging the drum. While a stop and sensor are shown and disclosed, it is appreciated that other known ways to limit the depth of the cut made from the cutting blade may be used and not depart from the scope of the present invention.

Figure 6:
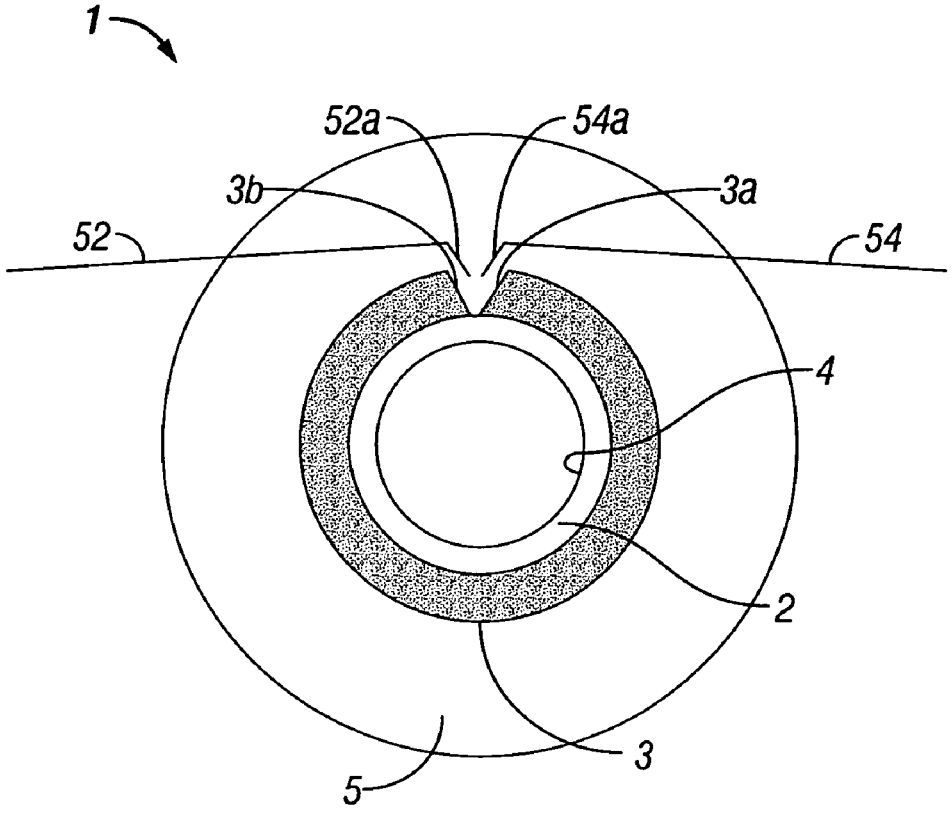
FIG. 6 is a cross-sectional view of the bobbin taken along line 6—6 of FIG. 5 and illustrates an incision in the remnant material and a pair of stripping plates according to one embodiment of the present invention.

The cutting blade preferably cuts the remnant material 3 wound about the bobbin 1 to form an incision therein defined by edges 3*a* and 3*b* (see FIG. 6). Once the incision has been made, the remnant material 3 from the bobbin 1 is preferably removed through operation of a pair of stripping plates 52 and 54.

Referring to FIGS. 1 and 6, in one preferred embodiment, the remnant material stripping assembly 15 includes stripping plate arms 48, 50 pivotally attached to the slide member 21 by axles 23, 25, respectively, that are positioned on opposing sides of the bobbin support shaft 16. In the preferred embodiment the locking plate arms 18,20 and stripping plate arms 48, 50 share common attachment points, namely axles 23 and 25. In particular, locking plate arm 18 and stripping plate arm 48 preferably share axle 23, while locking plate arm 20 and stripping plate arm 50 share axle 25. However, the arms in each set of locking and stripping plate arms 18/48, 20/50 are adapted to pivot independently of each other. For example, the left locking plate arm 18 is capable of pivoting independently of the corresponding left-side stripping plate arm 48. It is further appreciated that the arms may have different points of attachment and not depart form the scope of the present invention.

A pair of substantially horizontally extending stripping plates 52, 54 are preferably fixedly attached to the upper end 48*a*, 50*a* of each stripping plate arm 48,50, with stripping plate 52 attached to the upper end 48*a* of stripping plate arm 48 and stripping plate 54 attached to the upper end 50*a* of stripping plate arm 50. In operation, the stripping plates 52, 54 engage the remnant material 3 after the material 3 is cut to strip or pull the material 3 from the bobbin 1. In order to facilitate the engagement of the incision edge 3*a* and 3*b*, respectively, as illustrated in FIG. 6, it is appreciated that each of the stripping plates 52, 54 may be provided with a downwardly angled gripping portion 52*a*, 54*a*.

Stripping plate arm 48 is preferably biased or pulled toward locking plate arm 18, while stripping plate arm 50 is preferably biased toward locking plate arm 20. In a preferred embodiment, stripping plate arms 48 is pulled toward locking plate arm 18 by extension spring 56, while stripping plate arm 50 is pulled toward locking plate arm 20 by extension spring 58.

As noted herein above, the slide member actuator 27, locking arm actuators 26,28, turn activator 38, horizontal thruster 40 and vertical thruster 42, are each selectively actuated. In one embodiment, actuation of these devices is controlled through the use of a control panel (not shown), wherein these devices are individually controlled using buttons, switches or the like in a known way. In the alternative, the actuation of these devices may be controlled by a programmable computer (not shown) in a known way.

In operation, the bobbin 1 is preferably placed onto the bobbin support shaft 16. If a template is used, the bobbin may be placed for insertion into the template. If the bobbin does not fit within the template, the system may be adjusted to cut remnant material from the selected bobbin, or another bobbin may be selected for placement in the apparatus. It is appreciated that the bobbin may be manually placed on the bobbin support shaft 16 in a known way. It is also appreciated that the bobbin may be placed on the bobbin support shaft 16 through a known mechanical process such as, but not limited to, a conveyor belt assembly (not shown). In one embodiment of a mechanical process, a plurality of bobbins 1 having remnant material therein 3 are aligned on the conveyor belt assembly and individually removed for placement on the bobbin support shaft through a feeder/remover assembly (not shown) or other known mechanism. The bobbins may thereafter be mechanically removed after the remnant material is removed by the feeder/remover assembly (not shown) or other known mechanism. Once the bobbin is placed on the bobbin support shaft, it may be secured in place through the use of locking arms.

Referring again to FIG. 1, after the bobbin 1 has been placed onto the support shaft 16 the locking plated 22, 24 may be moved vertically and pivoted to engage the remnant material of the bobbin to substantially prevent any movement of the bobbin during the cutting process. The ends of the locking arms 18,20 may be serrated to increase the hold on the bobbin. Once the bobbin 1 is substantially secured in place on the support shaft 16, the horizontal thruster 40 and vertical thruster 42 move the cutting blade 32 from a first or original position A to a second position B, wherein the cutting blade engages and penetrates the remnant material 3. The horizontal thruster 40 then drives the cutting blade 32 horizontally in a forward direction along a path that extends substantially parallel to the bobbin drum 2, with the sharp edge of the cutting blade 32 facing the direction of movement, thus cutting the remnant material 3.

Once the cutting blade 32 has passed along the entire length of the remnant material 3 and has reached a third or end position C, thus completing a "stroke", the vertical thruster 42 lifts the cutting head 30 to a fourth position D, and the turn activator 38 rotates the combination cutting head shaft 34/cutting blade 32 180-degrees. Thereafter, the horizontal thruster 40 and vertical thruster 42 again position the cutting blade 32 to the third position C so that it engages and penetrates the remnant material 3. The horizontal thruster 40 then drives the cutting blade 32 horizontally in a reverse direction, with the sharp edge of the cutting blade 32 facing the direction of movement, thus cutting the remnant material 3 in a second or reverse direction.

Once the cutting blade 32 has passed along the entire length of the remnant material 3 and has reached the second position B, thus completing a second "stroke", the turn activator 38, horizontal thruster 40 and vertical thruster 42 reposition the cutting blade 32 so that another stroke can be completed, if necessary. This cycle preferably continues until the stop 44 engages the sensor 46, indicating that the maximum allowable and/or desired depth of the incision 3*a*, 3*b* has been reached. The horizontal thruster 40 and vertical thruster 42 may thereafter return the cutting head 30 to its original position A.

Actuated by the slide member actuator 27, the slide member 21 slides or translates down along the frame bracket 14, toward the lowered position. As the slide member 21 moves downward toward the lowered position, the locking plates 22, 24 also move down and pivot towards each other as they follow the contour of the bobbin drum 2. This causes the stripping plate arms 48, 50 to pivot towards each other, which in turn causes the stripping plates 52, 54 to move toward and engage the remnant material 3 as shown in FIG. 6. As the slide member 21 continues to move toward the lower position, the stripping plates 52, 54 pull the remnant material 3 down and away from the bobbin 1. In particular, the left stripping plate gripping portion 52*a* engages the incision left edge 3*b* of the incision, and the right stripping plate gripping portion 54*a* engages the incision right edge 3*a*. As the stripping plates 52, 54 move downward, they follow the contour of the drum 2, and the stripping plates 52, 54 pull the incision edges 3*a*, 3*b*, respectively, away from each other and substantially downward.

When the remnant material 3 is completely free from the bobbin 1, the remnant material 3 preferably freefalls into a container (not shown). The locking arm actuators 26, 28 pivot the locking plate arms 18, 20 away from the bobbin 1, and the slide member actuator 27 slides or translates the slide member 21 to the upper position so that the remnant-free bobbin 1 can be removed from the bobbin stripper 10.

The foregoing description of an embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims as set forth below.

What is claimed is:

1. A bobbin stripper for removing remnant material wound about a bobbin, comprising:

a base;

a frame bracket attached to the base;

means operably associated with the frame bracket for supporting the bobbin;

securing means operably associated with the frame bracket for substantially preventing any movement of the bobbin;

cutting means operably associated with the frame bracket for cutting the remnant material in a forward and a reverse direction; and stripping means operably associated with the frame bracket for stripping the remnant material from the bobbin.

2. A bobbin stripper for removing remnant material wound about a drum of a bobbin having a bore, comprising:

a base;

a frame bracket attached to the base;

means for supporting the bobbin on the frame bracket;

means operably associated with the frame bracket for substantially preventing any movement of the bobbin;

a cutting head moveably attached to the frame bracket, wherein the cutting head comprises:

a cutting element having a cutting edge;

means for supporting the cutting element within the cutting head;

means for moving the cutting element into and out of engagement with the remnant material;

means for moving the cutting element longitudinally along the drum of the bobbin to form an incision in the remnant material; and means for rotating the cutting element so the remnant material may be cut in both a forward and reverse direction; and means for stripping the remnant material from the bobbin.

3. The bobbin stripper of claim 2, which further comprises means to control the depth of the incision into the remnant material.

4. The bobbin stripper of claim 3 wherein the means to control the depth of the incision comprises an adjustable stop operable associated with the cutting head and a sensor operably associated with the frame bracket.

5. The bobbin stripper of claim 2 wherein the bobbin supporting means comprises a bobbin support shaft that is received by the fore of the bobbin.

6. The bobbin stripper of claim 5 wherein the bobbin support shaft comprises a tapered end.

7. The bobbin stripper of claim 2, which further comprises means to regulate the size of the bobbin that may be supported by the bobbin stripper.

8. The bobbin stripper of claim 7 wherein the bobbin size regulating means comprises on or more templates operably associated with the bobbin supporting means and that are sized to accept a bobbin of a particular size.

9. The bobbin stripper of claim 2 wherein the frame bracket is substantially U-shaped.

10. The bobbin stripper of claim 2 wherein the means for substantially preventing movement of the bobbin comprises a pair of locking plates and means for moving the locking plates into engagement with the bobbin.

11. The bobbin stripper of claim 10 wherein the means for moving the locking plates comprises:

a slide member;

a pair of licking plate arms, wherein each of the pair of locking plates is attached to one of the locking plate arms;

a slide member actuator for selectively actuating the slide member;

and a pair of locking plate arm actuators wherein each of the pair of locking plates arm actuators is operatively associated with one of the locking plate arms to permit the locking plates to pivot toward the bobbin.

12. The bobbin stripper of claim 11 wherein the slide member actuator comprises a hydraulic piston.

13. The bobbin stripper of claim 11 wherein the slide member actuator comprises a pneumatic piston.

14. The bobbin stripper of claim 11 wherein each of the locking plate arm actuators comprises a hydraulic piston.

15. The bobbin stripper of claim 11 wherein each of the locking plate arm actuators comprises a pneumatic piston.

16. The bobbin stripper of claim 2 wherein the means for rotating the cutting element comprises a selectively actuated turn activator.

17. The bobbin stripper of claim 2 where in the cutting element is a cutting blade.

18. The bobbin stripper of claim 2 wherein the means to move the cutting element into and out of engagement with the remnant material comprises a first thruster and the means for moving the cutting element longitudinally along the drum of the bobbin comprises a second thruster.

19. The bobbin stripper of claim 18 wherein the first thruster is attached to the bracket frame and the second thruster is attached to the cutting head.

20. The bobbin stripper of claim 18 wherein the first thruster is attached to the cutting head and the second thruster is attached to the bracket frame.

21. The bobbin stripper of claim 2 wherein the means for stripping the remnant material comprises:

a slide member;

a first stripping plate arm pivotally attached to the slide member;

a second stripping plate arm pivotally attached to the slide member;

a first stripping plate attached to the first stripping plate arm;

a second stripping plate attached to the second stripping plate arm; and means for biasing the first and second stripping plates to remove the remnant material from the bobbin.

22. The bobbin stripper of claim 21 wherein the biasing means comprises a first extension spring operatively associated with the first stripping plate and a second extension spring operatively associated with the second stripping plate.

23. The bobbin stripper of claim 21 wherein each of the first and second stripping plates further comprises a downwardly-angled gripping portion for engaging the incision in the remnant material.

24. A method of removing remnant material comprising the steps of:

providing a bobbin having a drum and remnant material located about the drum;

substantially securing the bobbin in place to substantially prevent movement of the bobbin;

cutting an incision into the remnant material through cutting passes performed in a first and second direction, said step of cutting an incision into the remnant material comprising moving a cutting blade having a cutting edge into engagement with the remnant material on the drum of the bobbin, moving the cutting blade substantially parallel to the drum of the bobbin such that the cutting edge makes an incision in the remnant material in said first direction, moving the cutting blade out of engagement with the remnant material, rotating the cutting blade, moving the cutting blade into engagement with the remnant material, moving the cutting blade substantially parallel to the drum of the bobbin in said second direction, and moving the cutting blade away form the remnant material.

25. The method of claim 24 wherein the steps of moving and rotating the cutting blade are repeated, if necessary.

26. The method of claim 24 which further comprises the step of indicating when the proper depth of the incision is achieved.

27. The method of claim 26 wherein the step of indicating when the proper incision depth is achieved comprises using a stop and a sensor.

28. The method of claim 24 wherein the step of substantially securing the bobbin comprises placing the bobbin on a support shaft.

29. The method of claim 28 wherein the support shaft is tapered.

30. The method of claim 24, which further comprises the step of determining whether the bobbin is the proper size.

31. The method of claim 30 wherein the step of determining whether the bobbin is the proper size comprises the step of using one or more templates that are sized to correlate with a bobbin of a particular size and shape.

32. The method of claim 24 wherein the step of substantially securing the bobbin comprises the step of pivotably moving a pair of licking plate into engagement with the remnant material on the bobbin.

33. The method of claim 32 wherein the locking plates each have a serrated end.

34. The method of claim 24 wherein the step of removing the remnant material comprises the step of engaging a pair of stripper plates with the incision in the remnant material.

35. The method of claim 34 wherein each of the stripper plates comprises a downwardly-angled gripping portion for engaging the incision.

* * * * *